US010638251B2

(12) United States Patent
Robinson et al.

(10) Patent No.: US 10,638,251 B2
(45) Date of Patent: Apr. 28, 2020

(54) CUSTOMIZING HEAD-RELATED TRANSFER FUNCTIONS BASED ON MONITORED RESPONSES TO AUDIO CONTENT

(71) Applicant: Facebook Technologies, LLC, Menlo Park, CA (US)

(72) Inventors: Philip Robinson, Seattle, WA (US); William Owen Brimijoin, II, Kirkland, WA (US); Henrik Gert Hassager, Redmond, WA (US)

(73) Assignee: Facebook Technologies, LLC, Menlo Park, CA (US)

( * ) Notice: Subject to any disclaimer, the term of this patent is extended or adjusted under 35 U.S.C. 154(b) by 0 days.

(21) Appl. No.: 16/209,608

(22) Filed: Dec. 4, 2018

(65) Prior Publication Data

US 2020/0045491 A1 Feb. 6, 2020

Related U.S. Application Data

(60) Provisional application No. 62/714,950, filed on Aug. 6, 2018.

(51) Int. Cl.
*H04S 7/00* (2006.01)
*H04R 3/00* (2006.01)
(Continued)

(52) U.S. Cl.
CPC ..... *H04S 7/304* (2013.01); *H04R 5/033* (2013.01); *H04S 3/008* (2013.01); *H04S 2400/01* (2013.01); *H04S 2420/01* (2013.01)

(58) Field of Classification Search
CPC . H04S 7/00; H04S 7/302; H04S 7/303; H04S 7/304; H04S 1/007; H04S 3/008;
(Continued)

(56) References Cited

U.S. PATENT DOCUMENTS 6,181,800 B1 1/2001 Lambrecht
7,917,236 B1 * 3/2011 Yamada ..... G10K 15/02 381/18
(Continued)

FOREIGN PATENT DOCUMENTS

JP 2017-143468 A 8/2017
KR 10-1725952 B1 4/2017
KR 10-2018-0051411 A 5/2018

OTHER PUBLICATIONS

Extended European Search Report, European Application No. 19157023.3, dated Jul. 24, 2019, 6 pages.
(Continued)

*Primary Examiner* — Thang V Tran
(74) *Attorney, Agent, or Firm* — Fenwick & West LLP

(57) ABSTRACT

The present disclosure relates to a method and audio system for customizing a set of head-related transfer functions (HRTFs) for a user of the audio system to account for the user's bias in hearing. The audio system first presents, via one or more speakers on a headset, audio content to the user wearing the headset, the audio content generated using a set of HRTFs. The audio system monitors responses of the user to the audio content. The audio system customizes the set of HRTFs for the user based on at least one of the monitored responses. The audio system updates audio content using the customized set of HRTFs. The audio system presents the updated audio content to the user with the speakers on the headset.

18 Claims, 5 Drawing Sheets

(51) Int. Cl.
*H04R 29/00* (2006.01)
*H04R 5/033* (2006.01)
*H04S 3/00* (2006.01)

(58) Field of Classification Search
CPC ... H04S 2420/01; H04S 2400/01; H04R 5/04; H04R 29/00; H04R 3/00; H04R 3/005; H04R 3/12; H04R 1/1075; G06F 3/012; G06F 3/013; G06F 3/0346
See application file for complete search history.

(56) References Cited

U.S. PATENT DOCUMENTS

| | | | | |
|---|---|---|---|---|
| 9,544,706 | B1 * | 1/2017 | Hirst | H04S 7/302 |
| 9,848,273 | B1 | 12/2017 | Helwani et al. | |
| 9,955,281 | B1 | 4/2018 | Lyren et al. | |
| 2010/0290636 | A1 * | 11/2010 | Mao | H04S 7/304 381/74 |
| 2012/0183161 | A1 * | 7/2012 | Agevik | H04S 7/302 381/303 |
| 2015/0303790 | A1 * | 10/2015 | Lin | H02M 1/4225 363/89 |
| 2017/0332186 | A1 * | 11/2017 | Riggs | G06F 3/012 |
| 2018/0192226 | A1 | 7/2018 | Woelfl et al. | |
| 2018/0249274 | A1 * | 8/2018 | Lyren | H04S 7/303 |
| 2018/0367937 | A1 * | 12/2018 | Asada | H04R 3/00 |

OTHER PUBLICATIONS

PCT International Search Report and Written Opinion, PCT Application No. PCT/US2018/064117, dated May 1, 2019, 10 pages.

* cited by examiner

CUSTOMIZING HEAD-RELATED TRANSFER FUNCTIONS BASED ON MONITORED RESPONSES TO AUDIO CONTENT

CROSS REFERENCE TO RELATED APPLICATION

This application claims the benefit and priority of U.S. Provisional Application No. 62/714,950 filed Aug. 6, 2018, which is incorporated by reference herein in its entirety.

BACKGROUND

This present disclosure generally relates to audio systems providing audio content to one or more users of an audio system, and more specifically to, audio systems monitoring user responses to audio content and customizing head-related transfer functions (HRTFs) for the user based on the monitored responses.

Headsets in an artificial reality system often include an audio system to provide audio content to users of the headsets. In the artificial reality environment, audio content can significantly improve a user's immersive experience with the artificial reality. Conventional audio systems implemented in headsets comprise audio devices (e.g., ear buds, headphones) positioned in proximity to both ears of a user and provide audio content to the user. However, conventional audio systems generally do a poor job of providing directional content. This is because the content is presented without regard to head-related transfer functions (HRTFs) of the user, and HRTFs vary from user to user (e.g., due to different shapes of the ear).

SUMMARY

The present disclosure relates to a method and audio system for customizing a set of head-related transfer functions (HRTFs) for a user of the audio system. The audio content is generated using a set of head related transfer functions (HRTFs). The audio system presents, via one or more speakers on a headset, the audio content to the user wearing the headset.

The audio system monitors responses of the user to the audio content. The monitored responses of the user may be associated with a perceived origin direction and/or location of the audio content. In cases where the set of HRTFs for the user used to generate the content are not fully individualized/customized to the user, a delta is present between a perceived origin direction, location, angle, solid angle, or any combination thereof and a target presentation direction and/or location of audio content. The audio system customizes the set of HRTFs for the user based on at least one of the monitored responses to reduce the delta. The audio system generates updated audio content using the customized set of HRTFs, and presents the updated audio content to the user with the speakers on the headset.

Embodiments according to the invention are in particular disclosed in the attached claims directed to an audio system and a method, wherein any feature mentioned in one claim category, e.g. method, can be claimed in another claim category, e.g. audio system, as well. The dependencies or references back in the attached claims are chosen for formal reasons only. However any subject matter resulting from a deliberate reference back to any previous claims (in particular multiple dependencies) can be claimed as well, so that any combination of claims and the features thereof is disclosed and can be claimed regardless of the dependencies chosen in the attached claims. The subject-matter which can be claimed comprises not only the combinations of features as set out in the attached claims but also any other combination of features in the claims, wherein each feature mentioned in the claims can be combined with any other feature or combination of other features in the claims. Furthermore, any of the embodiments and features described or depicted herein can be claimed in a separate claim and/or in any combination with any embodiment or feature described or depicted herein or with any of the features of the attached claims.

Figure 1:
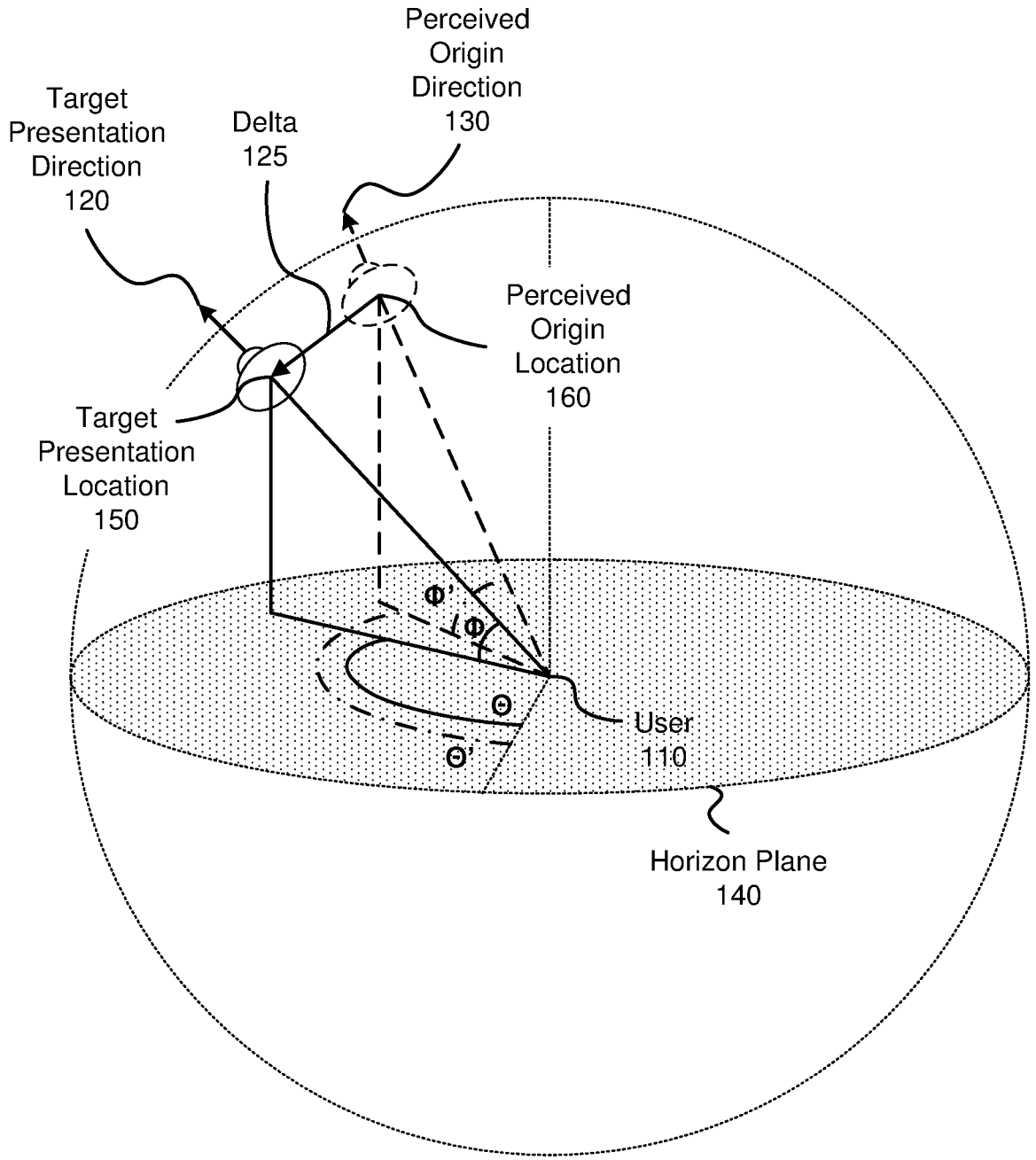
FIG. 1 is a perspective view of a user's bias in perceiving audio content, in accordance with one or more embodiments.

The figures depict embodiments of the present disclosure for purposes of illustration only. One skilled in the art will readily recognize from the following description that alternative embodiments of the structures and methods illustrated herein may be employed without departing from the principles, or benefits touted, of the disclosure described herein.

DETAILED DESCRIPTION

Embodiments of the invention may include or be implemented in conjunction with an artificial reality system. Artificial reality is a form of reality that has been adjusted in some manner before presentation to a user, which may include, e.g., a virtual reality, an augmented reality, a mixed reality, a hybrid reality, or some combination and/or derivatives thereof. Artificial reality content may include completely generated content or generated content combined with captured (e.g., real-world) content. The artificial reality content may include video, audio, haptic sensation, or some combination thereof, and any of which may be presented in a single channel or in multiple channels (such as stereo video that produces a three-dimensional effect to the viewer). Additionally, in some embodiments, artificial reality may also be associated with applications, products, accessories, services, or some combination thereof, that are used to, e.g., create content in an artificial reality and/or are otherwise used in (e.g., perform activities in) an artificial reality. The artificial reality system that provides the artificial reality content may be implemented on various platforms, including an eyewear device, a head-mounted display (HMD) assembly with the eyewear device as a component, a HMD connected to a host computer system, a standalone HMD, a mobile device or computing system, or any other hardware platform capable of providing artificial reality content to one or more viewers. In addition, the artificial reality system may implement multiple controller devices for receiving user input which may influence the artificial reality content provided to the user.

Overview

An audio system generates audio content according to a customized set of HRTFs for a user of the audio system. The audio system generates audio content using a set of HRTFs. The set of HRTFs may include one or more generic HRTFs, one or more customized HRTFs for the user, or some combination thereof. The audio system presents, via one or more speakers on a headset, audio content to the user wearing the headset. The audio system monitors responses of the user to the audio content with one or more monitoring devices. The monitored responses of the user may be associated with a perceived origin direction and/or location of the audio content. In cases where the set of HRTFs for the user used to generate the content are not fully individualized or customized to the user, a delta is present between the perceived origin direction and/or location and a target presentation direction and/or location of the audio content. The audio system customizes the set of HRTFs for the user based on at least one of the monitored responses to reduce a delta between perceived origin direction and/or location and a target presentation direction and/or location of audio content. The audio system generates subsequent audio content using the customized set of HRTFs. Customizing a set of HRTFs for the user is beneficial as it removes potential instances where there is a discrepancy between a user's perception of some virtual content and the user's perception of the audio content presented with the virtual content.

FIG. 1 is a perspective view of a user's 110 hearing perception in perceiving audio content, in accordance with one or more embodiments. An audio system presents audio content to the user 110 of the audio system. In this illustrative example, the user 110 is placed at an origin of a spherical coordinate system, more specifically a midpoint between the user's 110 ears. The audio system is generating audio content with a target presentation direction 120 with an elevation angle $\phi$ and an azimuthal angle $\Theta$ according to a set of HRTFs. Accordingly, the audio system presents audio content comprising binaural acoustic signals to the ears of the user 110. Due to the user's 110 hearing perception, the user 110 perceives the audio content is originating from a perceived origin direction 130 that is a vector with an elevation angle $\phi'$ and an azimuthal angle $\Theta'$. The elevation angles are angles measured from the horizon plane 140 towards a pole of the spherical coordinate system. The azimuthal angles are measured in the horizon plane 140 from a reference axis. In other embodiments, a perceived origin direction may include one or more vectors, e.g., an angle of vectors describing a width of perceived origin direction or a solid angle of vectors describing an area of perceived origin direction. Due to the HRTFs used to generate the audio content not being customized to the user 110, the user 110 may perceive the source to be more diffuse than the target presentation direction and/or location. Noticeably, there is a delta 125 between the target presentation direction 120 of the audio content and the user's 110 perceived origin direction 130. When considering the target presentation direction 120 and the perceived origin direction 130, the delta 125 corresponds to an angular difference between the two directions. The delta 125 may be due to a result of the set of HRTFs used to generate the audio content not being customized to the user's 110 hearing perception. In the case with the target presentation location 150 and the perceived origin location 160, the delta 125 may describe a distance difference between the target presentation location 150 and the perceived origin location 160.

The HRTFs can be tailored (e.g., using an audio system described in later figures) so as to reduce the delta between the target presentation direction 120 of the audio content and the user's 110 perceived origin direction 130. Likewise, the HRTFS can be tailored to reduce the delta 125 between a target presentation location 150 and a perceived origin location 160. In embodiments of the perceived origin direction including an angle and/or a solid angle, the HRTFs may be tailored so as to decrease the angle and/or the solid angle. The reduction in delta (between the target presentation direction 120 and the perceived origin direction 130 and/or the target presentation location 150 and the perceived origin location 160) can be advantageous in providing audio content in artificial reality systems. For example, customizing a set of HRTFs for the user 110 may avoid situations where the user 110 perceives a discrepancy between visual content of a virtual object and audio content of the virtual content.

Headset

Figure 2:
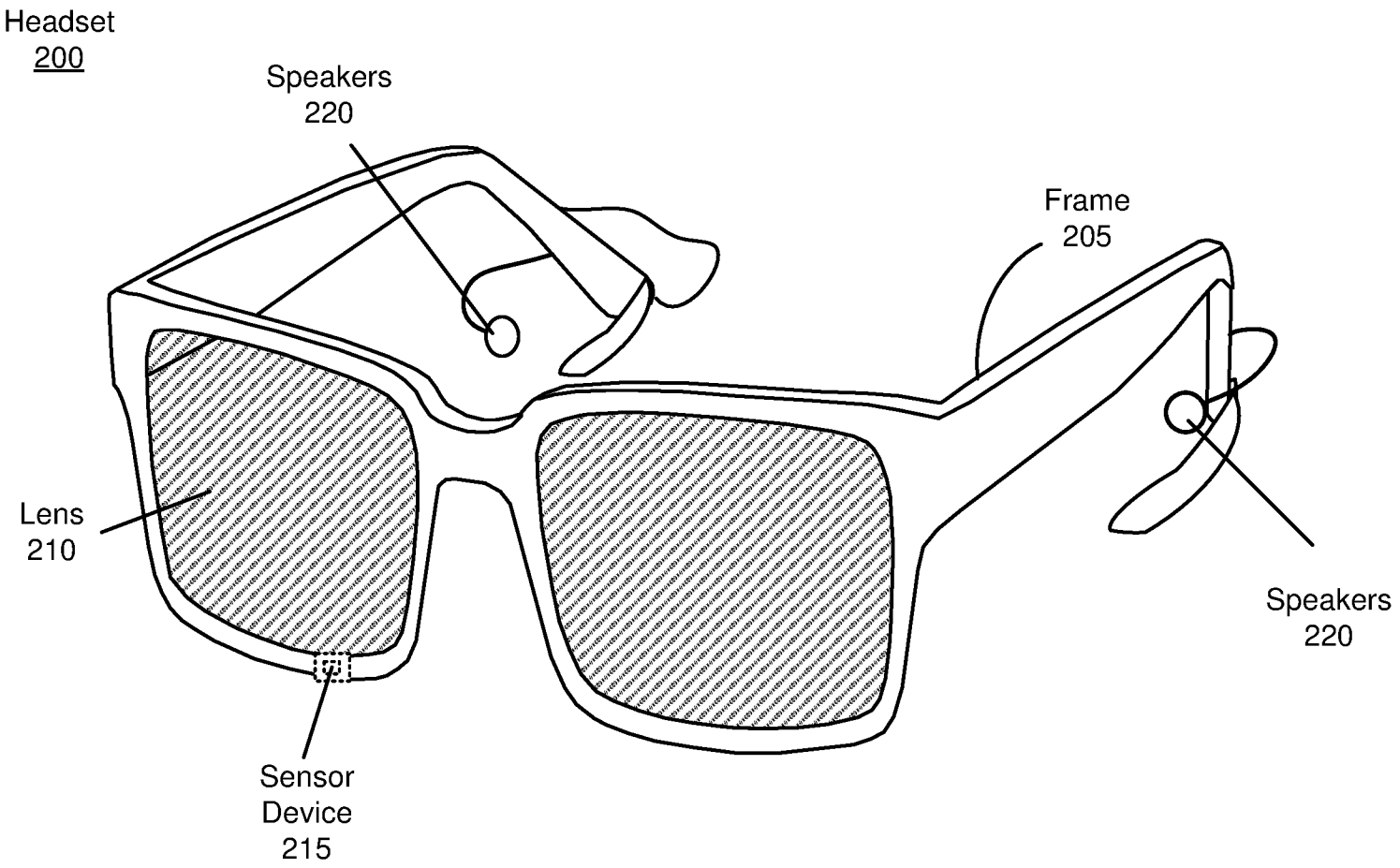
FIG. 2 is a perspective view of a headset including an audio system, in accordance with one or more embodiments.

FIG. 2 is a perspective view of a headset 200 including an audio system, in accordance with one or more embodiments. The headset 200 presents media to a user. Examples of media presented by the headset 200 include one or more images, video, audio, or some combination thereof. The headset 200 may be an eyewear device or a head-mounted display (HMD). The headset 200 includes, among other components, a frame 205, a lens 210, a sensor device 215, and an audio system.

In embodiments as an eyewear device, the headset 200 may correct or enhance the vision of a user, protect the eye of a user, or provide images to a user. The headset 200 may be eyeglasses which correct for defects in a user's eyesight. The headset 200 may be sunglasses which protect a user's eye from the sun. The headset 200 may be safety glasses which protect a user's eye from impact. The headset 200 may be a night vision device or infrared goggles to enhance a user's vision at night. In alternative embodiments, the headset 200 may not include a lens 210 and may be a frame 205 with the audio system that provides audio content (e.g., music, radio, podcasts) to a user. In other embodiments of the headset 200 as a HMD, the headset 200 may be a HMD that produces artificial reality content for the user.

The frame 205 includes a front part that holds the lens 210 and end pieces to attach to the user. The front part of the frame 205 bridges the top of a nose of the user. The end pieces (e.g., temples) are portions of the frame 205 to which the temples of a user are attached. The length of the end piece may be adjustable (e.g., adjustable temple length) to fit different users. The end piece may also include a portion that curls behind the ear of the user (e.g., temple tip, ear piece).

The lens 210 provides or transmits light to a user wearing the headset 200. The lens 210 is held by a front part of the frame 205 of the headset 200. The lens 210 may be prescription lens (e.g., single vision, bifocal and trifocal, or progressive) to help correct for defects in a user's eyesight. The prescription lens transmits ambient light to the user wearing the headset 200. The transmitted ambient light may be altered by the prescription lens to correct for defects in the user's eyesight. The lens 210 may be a polarized lens or a tinted lens to protect the user's eyes from the sun. The lens 210 may be one or more waveguides as part of a waveguide display in which image light is coupled through an end or edge of the waveguide to the eye of the user. The lens 210 may include an electronic display for providing image light and may also include an optics block for magnifying image light from the electronic display. Additional detail regarding the lens 210 can be found in the detailed description of FIG. 5.

The sensor device 215 estimates a current position of the headset 200 relative to an initial position of the headset 200.

The sensor device 215 may be located on a portion of the frame 205 of the headset 200. The sensor device 215 includes a position sensor and an inertial measurement unit. The sensor device 215 may also include one or more cameras placed on the frame 205 in view or facing the user's eyes. The one or more cameras of the sensor device 215 are configured to capture image data corresponding to eye positions of the user's eyes. Additional details about the sensor device 215 can be found in the detailed description of FIG. 5.

The audio system provides audio content to a user of the headset 200. The audio system includes an audio assembly, a monitoring assembly, and a controller. The monitoring assembly contains one or more monitoring devices for monitoring responses of the user to audio content. The monitoring devices may be various sensors or input devices that monitor response of the user. In one embodiment, the sensor device 215 is a monitoring device and tracks movement of the headset 200 as monitoring data. The monitoring assembly is described further in conjunction with FIGS. 3 & 4. The controller is also part of the audio system and manages operation of the audio assembly and the monitoring assembly.

The audio assembly provides audio content to a user of the headset 200. The audio assembly includes a plurality of speakers 220 that provide audio content in accordance with instructions from the controller. In the illustrated embodiment of FIG. 2, the speakers 220 are coupled to the end pieces of the frame 205. The speakers 220 may be placed so as to be in proximity to the user's ear canals or inside the user's ear canals when the user is wearing the headset 200, on another portion of the frame 205 and/or in a local area, or some combination thereof. Based on a placement of the speakers relative to a user's ears, the audio assembly 220 may assign speakers to be for a user's right ear or for a user's left ear. When presenting audio content, the audio assembly may receive binaural acoustic signals for specific actuation of speakers assigned to each of the user's ears. Additional detail regarding the structure and the function of the audio assembly can be found in the detailed description of FIGS. 3 & 4.

The controller provides audio content to the audio assembly 220 for presentation. The controller is embedded into the frame 205 of the headset 200. In other embodiments, the controller may be located in a different location (e.g., different portion of the frame 205 or external to the frame 205. The controller generates audio content according to a set of HRTFs and based on a target presentation direction and/or location for the audio content. The audio content provided to the audio assembly 220 may be binaural acoustic signals that dictate actuation of the speakers to present specific content to each of the user's ears. The functions and operations of the controller in providing audio content to the audio assembly will be further described in conjunction with FIGS. 3 & 4.

The controller adjusts the set of HRTFs according to monitored responses. The controller obtains monitored data from the monitoring assembly. With the monitored data, the controller determines monitored responses of the user in response to audio content provided by the audio assembly. The controller customizes the set of HRTFs for the user of the headset 200 according to the monitored responses. The controller then generates updated audio content according to the customized set of HRTFs for the user. Additional detail regarding the controller and the controller's operation with other components of the audio system can be found in the detailed description of FIGS. 3 & 4.

Audio System

Figure 3:
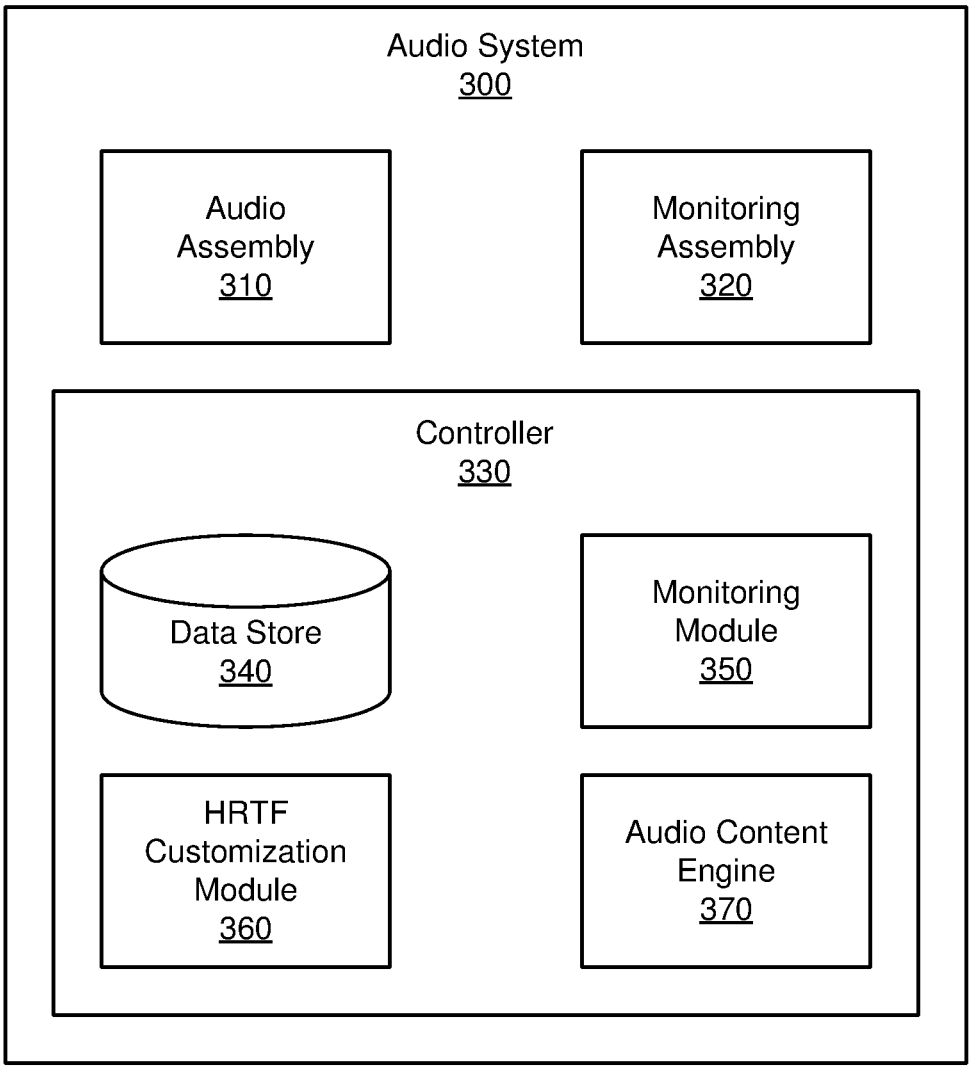
FIG. 3 is a block diagram of an audio system, in accordance with one or more embodiments.

FIG. 3 is a block diagram of an audio system 300, in accordance with one or more embodiments. The audio system of FIG. 2 may be an embodiment of the audio system 300. In other embodiments, the audio system 300 is a component of a headset providing audio content to the user. The audio system 300 includes an audio assembly 310, a monitoring assembly 320, and a controller 330. Some embodiments of the audio system 300 have different components than those described here. Similarly, the functions can be distributed among the components in a different manner than is described here.

The audio assembly 310 provides audio content to a user of the audio system 300. The audio assembly 310 includes speakers that provide the audio content in accordance with instructions from the controller 330. The speakers of the audio assembly 310 may be placed on any combination of a headset of which the audio system 300 is a component of and a local area of the audio system 300. The audio assembly 310 is configured to provide audio content to both ears of a user of the audio system 300 with the speakers. In some embodiments, the audio assembly 310 provides sound to a user over a total range of frequencies. The audio assembly 310 receives audio content from the controller 340 and presents the audio content to the user. The audio assembly of FIG. 2 is an embodiment of the audio assembly 310. The speakers generate acoustic pressure waves based using an electric signal. A speaker may be, e.g., a moving coil transducer, a piezoelectric transducer, some other device that generates an acoustic pressure wave using an electric signal, or some combination thereof. A typical moving coil transducer includes a coil of wire and a permanent magnet to produce a permanent magnetic field. Applying a current to the wire while it is placed in the permanent magnetic field produces a force on the coil based on the amplitude and the polarity of the current that can move the coil towards or away from the permanent magnet. The piezoelectric transducer comprises a piezoelectric material that can be strained by applying an electric field or a voltage across the piezoelectric material. Some examples of piezoelectric materials include a polymer (e.g., polyvinyl chloride (PVC), polyvinylidene fluoride (PVDF)), a polymer-based composite, ceramic, or crystal (e.g., quartz (silicon dioxide or $SiO_2$), lead zirconate-titanate (PZT)). One or more speakers placed in proximity to the ear of the user may be coupled to a soft material (e.g., silicone) that attaches well to an ear of a user and that may be comfortable for the user.

The monitoring assembly 320 monitors a user. In some embodiments, the monitoring assembly 320 includes one or more monitoring devices for recording monitoring data of the user. The monitoring devices may be various sensors for recording movement of the user or input devices that can be configured to receive input from the user. Monitoring devices may include, e.g., a position sensor, an IMU, a body-tracking camera, an eye-tracking camera, a hand controller, or some combination thereof. Various embodiments of monitoring devices are discussed below. The monitoring assembly 320 may contain any combination of any number of the various monitoring devices discussed above. The monitoring assembly 320 monitors the user when provided with audio content from the audio assembly 310. In other embodiments, one or more monitoring devices are components of other systems (e.g., tracking system, input/output interface, etc.) and provide the monitoring assembly 320 with monitoring data.

In some embodiments, a position sensor and/or an IMU are monitoring devices configured to record movement of headset. The position sensor and the IMU may be placed on a headset (e.g., the headset 200) used in tandem with the audio system 300. The position sensor and the IMU can track movement of the headset including recording positions of the headset and/or motion (e.g., translational or rotational) of the headset. The tracked headset movement is monitoring data provided to the controller 330.

In some embodiments, a body-tracking camera is a monitoring device configured to record movement of a user's body. In some embodiments, the body-tracking camera is placed in a location where the camera is capable of capturing a majority up to an entirety of the user's body. In examples with a headset in use with the audio system, the body-tracking camera may be external to the headset and situated in some proximity to the user with an unobstructed line of sight of the user. The body-tracking camera in this setup is used to capture movement of the user's body—such as the user's limbs, the user's head, the user's torso, the user's legs, other parts of the user's body, etc.—as monitoring data. The tracked body movement is monitoring data provided to the controller 330.

In some embodiments, an eye-tracking camera is placed on a headset and is configured to record movement of one or more of the user's eyes. The eye-tracking camera may be placed on an interior frame of the headset with an unobstructed line of sight of the user's eyes. In some implementations, each eye has one or more eye-tracking cameras designated to track eye movement. In some embodiments, the eye-tracking camera captures an image of the user's eye for tracking the eye movement. In other embodiments, an illumination device emits light (e.g., infrared light, visible light, etc.) towards the user's eyes which then reflect the light. In response, the eye-tracking cameras are configured to measure the reflected light off the user's eyes to track eye movement. Tracked eye movement may include any combination of one or more eye positions and motion of the eyes. The tracked eye movement are monitoring data provided to the controller 330.

In some embodiments, a hand controller is a monitoring device configured to receive one or more inputs from the user. The hand controller may be a hand-held monitoring device that receives one or more inputs from the user. The hand controller may comprise any combination of buttons, thumbsticks, or other conventional input devices for hand controllers. The hand controller may further include a position sensor and/or IMU for tracking a position of the hand controller in a local area. The input responses and/or the tracked hand controller movement is monitoring data provided to the controller 330.

The controller 330 controls operation of other components of the audio system (e.g., the audio assembly 310). The controller 330 generates audio content according to a set of HRTFs for a user of the audio system 300. The controller 330 provides the audio assembly 310 with the audio content to be presented to the user. The controller 330 obtains monitoring data from the monitoring assembly 320. With the monitoring data, the controller 330 may determine one or more monitored responses of the user in response to the audio content presented by the audio assembly 310. The controller 330 further customizes the set of HRTFs for the user according to one or more monitored responses. The controller 330 may then generate updated audio content with the customized set of HRTFs which is then provided to the user via the audio assembly 310. The controller 330 comprises a data store 340, a monitoring module 350, a HRTF customization module 360, and an audio content engine 370. In other embodiments, the controller 330 comprises additional or fewer components than those listed herein. Moreover the functions and operation of the various components may be variably dispersed among the components of the controller 330.

The data store 340 stores data for use by the audio system 300. Data in the data store 340 may include any combination of audio content, one or more HRTFs, other transfer functions for generating audio content, monitoring data, one or more monitored responses, user profiles, other data relevant for use by the audio system 300, etc. Audio content comprises sound to be presented to a user of the audio system 300. Audio content may additionally specify a target presentation direction and/or a location of a virtual source of the audio content within a local area of the audio system 300. Each target presentation direction is a spatial direction of virtual source for the sound. In addition, a target presentation location is a spatial position of the virtual source. For example, audio content includes an explosion coming from a first target presentation direction and/or location behind the user and a bird chirping coming from a second target presentation direction and/or location in front of the user. In some embodiments, the target presentation directions and/or locations may be organized in a spherical coordinate system with the user at an origin of the spherical coordinate system. Each target presentation direction is then denoted as an elevation angle from a horizon plane and an azimuthal angle in the spherical coordinate system. A target presentation location includes an elevation angle from the horizon plane, an azimuthal angle, and a distance from the origin the spherical coordinate system.

The HRTFs may be subdivided into sets of HRTFs individualized for one or more users of the audio system 300. The sets of HRTFs may be further associated to corresponding user profiles for each user storing other relevant information or settings. The sets of HRTFs may be retrieved for use or modification by other components of the controller 330. Each set of HRTF may be used to define binaural acoustic signals for audio content according to the target presentation direction(s) and/or location(s). An HRTF is a transfer function relating how an ear detects acoustic pressure waves that originate from audio content presented at a spatial position in space. In relation to the audio system 300, HRTFs transform sounds at target presentation directions and/or locations in a local area into binaural acoustic signals for presentation of the audio content by the audio assembly 310.

The monitoring module 350 determines one or more monitored responses of the user according to monitoring data from the monitoring assembly 320. The monitored responses to the audio content may be any combination of a position of a limb of the user, a movement of a body of the user, a movement of the headset, an orientation of the headset, a gaze location of the user, an input from the user, another type of response from the user, etc. The monitoring assembly 320 provides the monitored responses to the controller 330. The monitoring module 350 determines a perceived origin direction and/or location of the audio content based on one or more of the monitored responses which are discussed below. The perceived origin direction and/or location of the audio content corresponds to the user's perception of the audio content's origin. In additional embodiments, the monitoring module 350 may further control operation of the monitoring devices in the monitoring assembly 320. For example, the monitoring module 350 may selectively activate each monitoring device to record the user. The monitoring module 350 may further provide the monitored responses and/or the monitoring data to the data store 340 for storage.

In embodiments with tracked headset movement as monitoring data, the monitoring module 350 determines a perceived origin direction and/or location of the audio content based on the tracked headset movement. The tracked headset movement may include any combination of headset positions and headset rotations tracked by the position sensor and/or the IMU in the headset. Due to the user's perceived origin direction and/or location of the audio content, the user may turn their head to face the perceived origin direction and/or location of the audio content. The monitoring module 350 may compare an initial headset position prior to providing the audio content and an eventual headset position during and/or after the audio content is provided. Based on the eventual headset position, the monitoring module 350 may determine an orientation of the headset corresponding to the user's perceived origin direction and/or location. The monitoring module 350 may define a monitored response as the movement and/or orientation of the headset in response to the audio content, e.g., from the initial headset position to the eventual headset position. In addition, due to the user's perceived origin direction and/or location of the audio content, a speed at which the user turns their head may also correlate to the user's perceived origin direction and/or location, e.g., the user turns their head faster for a perceived origin direction and/or location that is behind them compared to a perceived origin direction and/or location to their side. The headset rotations may include any combination of a rotation axis, a rotational speed, and a rotational acceleration. Based on headset rotation, the monitoring module 350 may determine a predicted position of the headset by calculating the predicted position with the rotation axis and either the rotational speed or the rotational acceleration. The monitoring module 350 may define a monitored response as the movement and/or orientation of the headset in response to the audio content, e.g., from the initial headset position to the predicted headset position.

In some embodiments with tracked body movement as monitoring data, the monitoring module 350 determines a perceived origin direction and/or location of the audio content based on a tracked body movement. In some embodiments, the audio system 300 additionally prompts the user to move their body in a specific manner in response to the user's perception of the audio content's origin. For example, the user may be prompted to point with an arm at a perceived origin direction and/or location of the audio content. In either case, the tracked body movement of the user corresponds to the user's perceived origin direction and/or location. The monitoring module 350 may define a monitoring response as the movement of the user's body. Following this example, the monitoring module 350 may determine the perceived origin direction by determining a direction that the user is pointing from the tracked body movement recorded by the body-tracking camera. In another example, the tracked body movement may include a motion of the user in response to the audio content. The monitoring module 350 may determine the user's perceived origin direction and/or location based on the user's motion. For example, the audio content is presented and the user responds by rotating their body to towards their left by 120°; the monitoring module 350 may determine that the user's perceived origin direction is at least 120° to the left of the user's initial body position.

In some embodiments with tracked eye movement as monitoring data, the monitoring module 350 determines a perceived origin direction and/or location of the audio content based on tracked eye movement. Based on the tracked eye movement, the monitoring module 350 determines a gaze location of the user's eyes based on the eye positions. The monitoring module 350 traces a ray from each eye based on the eye position and determines the gaze location as an intersection of the two rays. The gaze location is a position to which the user's eyes are converged. The monitoring module 350 may define a monitored response as the gaze location of the user. The monitoring module 350 determines the perceived origin direction of the audio content as a ray from the user to the gaze location. In other embodiments, the monitoring module 350 determines the perceived origin location of the audio content as the gaze location. The tracked eye movement (with the gaze location, the eye positions, etc.) may be defined in a coordinate system relative to the headset or in the spherical coordinate system discussed above in FIG. 1 relative to the local area.

In some embodiments with received inputs as monitoring data, the monitoring module 350 determines a perceived origin direction and/or location of the audio content based on received inputs from the user. In one example with a hand controller, the user is prompted by the audio system 300 to provide an input by pointing an arm holding the hand controller in a direction that the user perceives to be a perceived origin direction of the audio content and then pressing a button on the hand controller. The position sensor of the hand controller may track an orientation of the user's arm and the button receives an input. Accordingly, the monitoring module 350 determines an orientation of the user's arm at the time the button received the input. The monitoring module 350 determines the user's perceived origin direction and/or location based on the orientation of the user's arm. In another example, the thumbstick receives a directional input. The monitoring module 350 may determine the perceived origin direction and/or location based on the directional input.

In further embodiments, the monitoring module 350 determines a perceived origin direction and/or location of the audio content based on a combination of the monitored responses described above. In one example, the monitoring module 350 determines a first monitored response of the user's body movement, a second monitored response of the headset movement, and a third monitored response of the user's eye movement. The monitoring module 350 may determine the perceived origin direction and/or location of the audio content based on a combination of the monitored responses. For example, the monitoring module 350 considers the user's body direction, the headset direction, and the user's gaze location in order to determine the perceived origin direction and/or location.

The HRTF customization module 360 customizes HRTFs for a user according to the monitored responses. In one or more embodiments, the HRTF customization module 360 further uses perceived origin directions and/or locations as determined by the monitoring module 350. In some embodiments, the HRTF customization module 360 determines a difference (e.g., delta) between the target presentation direction and/or location of the audio content and a perceived origin direction and/or location according to the monitored responses. The difference when considering directions may include an elevation differential in elevation angles corresponding to a user's elevation bias and a lateralization differential in azimuthal angles corresponding to a user's lateralization bias. In other embodiments, the difference when considering locations may include an elevation differential in elevation angles, a lateralization differential in azimuthal angles, and a distance differential.

The HRTF customization module 360 adjusts the HRTFs in the data store 340 based on the determined difference. Each of the HRTFs is a transfer function with different transforms and associated weights that transform audio content with a target presentation direction and/or location to binaural acoustic signals for actuation of the speakers in the audio assembly 310. When adjusting an HRTF, the HRTF customization module 360 adjust the weights of the transforms to increase or decrease their influence in the creating the binaural acoustic signals. HRTFs may have several features that may be adjusted to account for a user's hearing perception. For lateralization, an interaural time difference (ITD) or the difference in a sound wave's arrival time at each ear indicates lateralization and is dependent upon the physical separation between a user's ears. If, based on monitored responses, there is a determination of a skew in the lateralization either towards or away from the center, the HRTF customization module 360 may scale the ITD appropriately. In elevation, height perception is correlated with spectral features—i.e. spectral peaks and/or notches—in the frequency response of the HRTF. The HRTF customization module 360 may adjust the HRTFs with any combination of adjusting the frequency and magnitude of spectral features in the HRTFs, introducing new spectral features, and eliminating contradictory spectral features. In additional embodiments, according to the user's elevation bias, the HRTF customization module 360 generates an elevation model of the HRTF spectral features as a function of the elevation bias. The HRTF customization module 360 adjusts HRTFs with the elevation model. In embodiments of the perceived origin direction including an angle and/or a solid angle, the HRTF customization module 360 may adjust the HRTFs to decrease the diffuseness of the audio content at the target presentation direction and/or location. These are but a few examples, as in practice, there may be other manners of adjusting various features present in the HRTFs.

Following are other examples of manners for adjusting HRTFs. In some embodiments, the HRTF customization module 360 adjusts an HRTF for any combination of the user's lateralization bias and the user's elevation bias with the principles described above. In another embodiment using the spherical harmonic domain, the HRTF customization module 360 may adjust a sound field to account for a user's hearing perception. The HRTF customization module 360 may iteratively adjust the HRTFs until adjustments are within a degree of insignificance at which point the HRTF customization module 360 deems the HRTFs to be completely customized to the user.

In some embodiments, the HRTF customization module 360 determines a cluster of perceived origin directions and/or locations for a single target presentation direction and/or location. The audio assembly 310 presents audio content at a single target presentation direction and/or location at different temporal instances. The monitoring assembly 310 records monitoring data throughout the temporal instances. The monitoring module 350 determines monitoring responses for each temporal instance and may also determine a perceived origin direction and/or location for each temporal instance. After multiple temporal instances, the HRTF customization module 360 may determine a cluster of perceived origin directions and/or locations for the single target presentation direction and/or location. The HRTF customization module 360 then determines a direction and/or location of the cluster, which may be a centroid of the cluster—either an average direction of the cluster when considering directions or an average location of the cluster when considering locations. The benefit of using the cluster allows for a greater sampling to account for variability in the perceived origin directions and/or locations either due to user variability or determination variability.

The HRTF customization module 360 may store HRTFs in the data store 340. In some embodiments, the HRTF customization module 360 initializes a set of HRTFs for a user using the audio system 300 without a customized set of HRTFs. The initialized set of HRTFs may be generated using one or more generic HRTFs and a model of the user. The generic HRTFs may be created from an average of many sets of HRTFs customized for training individuals. The model of the user may be created by the HRTF customization module 360 that approximates the user's body and head shape. For example, the audio system 300 may receive inputs from the user regarding various dimensions of their body, e.g., height, weight, relative size of ears, relative size of head, etc. Based on the received inputs, the HRTF customization module 360 generates a model of the user by modifying one or more generic HRTFs with the received inputs. After customizing a set of HRTFs for a user according to the principles described above, the HRTF customization module 360 may store the customized set of HRTFs in the data store, e.g., under a user profile associated with that user. In additional embodiments, the HRTF customization module 360 may update a user's customized set of HRTFs by adjusting one or more of the HRTFs.

The audio content engine 370 generates audio content for presentation to a user of the audio system 300. The audio content engine 370 identifies an opportunity to present audio content to the user of the audio system 300, e.g., when a flag in a virtual experience comes up for presenting audio content. The audio content engine 370 accesses the data store 340 to retrieve a set of HRTFs for the user. The audio content engine 370 also retrieves audio content to provide to the user according to the identified opportunity. The audio content engine 370 then generates audio content to provide to the audio assembly 310 based on the audio content and the set of HRTFs. In some embodiments, the generated audio content for the audio assembly 310 comprises binaural acoustic signals to be for actuation by one or more speakers of the audio assembly 310. In some embodiments, the set of HRTFs may be an initialized set of HRTFs not yet customized to the user. In other embodiments, the set of HRTFs may have been at least partially customized to the user by the HRTF customization module 360. In other embodiments, the audio content engine 370 may obtain a virtual model of a local area where the user is located within the virtual space. The virtual model of the local area may include one or more area-related transfer functions that transform sounds propagating in a local area into binaural acoustic signals according to the virtual model of the local area. In one example of a virtual model, the virtual model is that of an office with a desk and a chair. The one or more area-related transfer functions of this example virtual model may describe reflective properties of the desk, the chair, the surfaces of the office, etc. In these embodiments, the audio content engine 370 may use the HRTFs and the virtual model of the local area—including the one or more area-related transfer functions—to generate audio content for the user. The audio content engine 370 provides the generated audio content to the assembly 310 for presentation to the user.

In comparison to the audio system 300, many conventional audio systems are laborious and time-intensive techniques. Some conventional audio systems attempt to solve the same issue by customizing a set of HRTFs for each user.

However, one such conventional audio system relies on placing a user in a sound-insulated room with speakers positioned all around the user and audio receivers in each ear of the user. As the speakers individually present a sound, the audio receivers detect acoustic signals. This conventional audio system can use the detected acoustic signals to calculate a personalized set of HRTFs for the user. A similar conventional audio system also places a user in a sound-insulated room with audio receivers, rather, positioned all around the user and speakers placed in each ear of the user. In a converse manner, the speakers present sound which is then detected by the audio receivers placed all around the user. This conventional audio system can also use the detected acoustic signals to calculate a personalized set of HRTFs. In a third conventional manner of determining a personalized set of HRTFs, an imaging device is used to scan a three-dimensional (3D) model of the user's head. The 3D model is then used to theoretically calculate a personalized set of HRTFs. All of these conventional audio systems require highly time-intensive techniques. The first two systems have the additional downfall of needing to isolate the user into a sound-insulated room for a potentially long duration of time. The third system has the added disadvantage of heavy computational work to approximate the personalized set of HRTFs based on the 3D model of the user's head.

The audio system 300 provides numerous advantages compared to conventional audio systems. The audio system 300 provides for a simpler method of customizing a set of HRTFs for a user. As opposed to the conventional audio systems described above, the audio system 300 can customize a set of HRTFs with an audio system 300 integrated into a headset. Moreover, the audio system 300 can be placed in an environment that is not restricted to a sound-insulated environment. In some embodiments of the audio system 300, the audio system 300 may customize the set of HRTFs in the background while the audio system 300 is providing audio content for some experience (e.g., an artificial reality experience).

Figure 4:
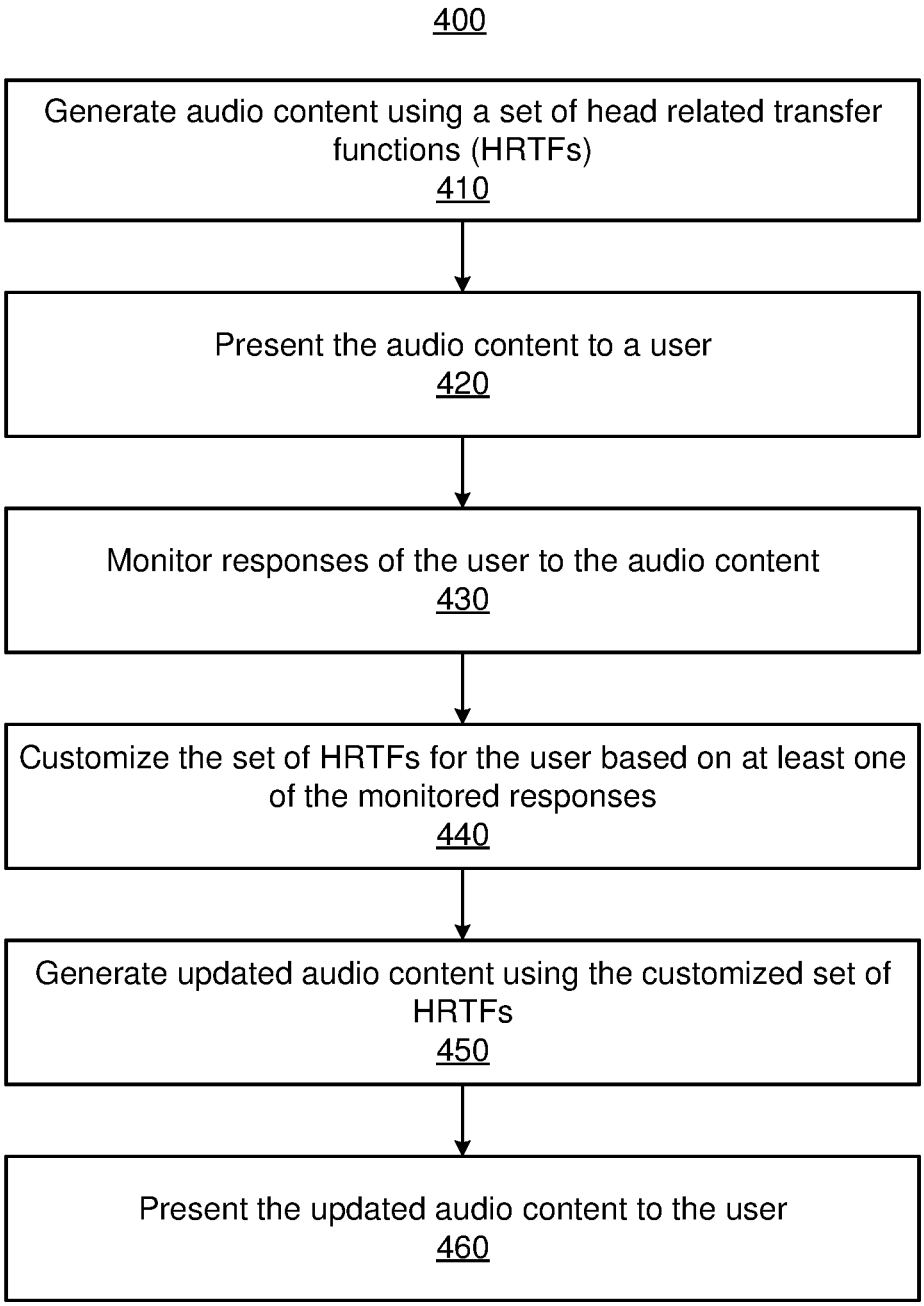
FIG. 4 is a flowchart illustrating a process for customizing a set of HRTFs for a user based on monitored user responses, in accordance with one or more embodiments.

FIG. 4 is a flowchart illustrating a process 400 for customizing a set of HRTFs for a user based on monitored user responses, in accordance with one or more embodiments. In one embodiment, the process of FIG. 4 is performed by components of an audio system (e.g., the audio system 300). Other entities may perform some or all of the steps of the process in other embodiments (e.g., a console). Likewise, embodiments may include different and/or additional steps, or perform the steps in different orders.

The audio system 300 generates 410 audio content using a set of HRTFs. In some embodiments, the controller 330—or more specifically the audio content engine 370—of the audio system 300 generates 410 the audio content. The audio content engine 370 retrieves a set of HRTFs from the data store 340. In some cases, the set of HRTFs are not yet customized to the user. In other cases, the set of HRTFs have undergone partial or full customization. The audio content may be expressly generated for calibrating the set of HRTFs or may be generated for some experience (e.g., audio content as part of a virtual game or virtual experience). The generated audio content may be provided from the audio content engine 370 to the audio assembly 310.

The audio system 300 presents 420 the audio content to the user. In some embodiments, the audio assembly 310 of the audio system 300 presents 420 the audio content with one or more speakers that are placed in any combination of a headset and in a local area surrounding the user. The audio assembly 310 receives the generated audio content which may comprise binaural acoustic signals for generation of acoustic pressure waves to each ear of the user. The audio assembly 310 includes one or more speakers that provide the audio content to the ears of the user.

The audio system 300 monitors 430 responses of the user to the audio content. The user may respond to the audio content in many different ways. The monitoring assembly 320 and/or the monitoring module 350 of the audio system 300 monitors the user and records monitoring data. From the monitoring data, the audio system 300 determines monitored responses. Of many possible responses, the monitored responses detected by the audio system 300 may be any combination of a position of a limb of the user, a movement of a body of the user, a movement of the headset, an orientation of the headset, a gaze location of the user, an input from the user, another type of response from the user, etc. The monitored responses suggest the user's hearing perception in identifying a source of audio content presented from the audio system 300. In some additional embodiments, the audio system 300 may first prompt the user to respond to the audio content provided, to which the user responds. The monitoring assembly 320 then records the responses after the prompting.

In one example of monitoring 430 responses of the user, the audio system 300 records a movement of the headset and a movement of the user's eyes in response to presentation of audio content. The audio system 300 obtains monitoring data from one or more monitoring devices which may include tracked headset movement and tracked eye movement. The audio system 300 determines one or more monitored responses with the monitoring data, e.g., movement of the headset 120° in an azimuthal angle and 10° in an elevation angle with a movement of the user's eyes at a gaze location at 5° in an azimuthal angle relative to a headset, 5° in an elevation angle relative to the headset, and at 1 meter away from the headset. With the monitored responses, the audio system 300 determines the perceived origin direction and/or location, e.g., determining a perceived origin direction 125° in an azimuthal angle (summing 120° and 5°) and 15° in an elevation angle (summing 10° and 5°) and/or a perceived origin location with the same perceived origin direction and 1 meter in distance.

In some embodiments, the audio system 300 determines a cluster of perceived origin directions and/or locations for a single target presentation direction and/or location. The audio system 300 presents audio content at a single target presentation direction and/or location at different temporal instances. The user's response to each temporal instance of audio content from the target presentation direction and/or location may indicate a perceived origin direction and/or location. After multiple temporal instances, the audio system 300 may determine a cluster of perceived origin directions and/or locations for the single target presentation direction and/or location. The audio system 300 then determines a direction and/or location of the cluster, which may be a centroid of the cluster—either an average direction of the cluster when considering directions or an average location of the cluster when considering locations. The benefit of using the cluster allows for a greater sampling to account for variability in the perceived origin directions and/or locations either due to user variability or determination variability.

The audio system 300 customizes 440 the set of HRTFs for the user based on at least one of the monitored responses. Customization of the HRTFs may include adjustment of one or more HRTFs included in the set of HRTFs to account for the user's bias. In one or more embodiments, the HRTF customization module 360 determines a difference (e.g., a delta) between a target presentation direction and/or location and the perceived origin direction and/or location. When considering directions, the difference may include an elevation differential in elevation angles corresponding to a user's elevation bias and a lateralization differential in azimuthal angles corresponding to a user's lateralization bias. When considering locations, the difference may include an elevation differential in elevation angles, a lateralization differential in azimuthal angles, and a distance differential. The HRTF customization module 360 may customize the HRTFs according to the calculated difference with the goal of reducing a difference between the audio content's target presentation direction and the perceived origin direction according to the user's bias. In one or more embodiments, the controller 330—or more specifically the HRTF customization module 360—of the audio system 300 customizes 440 the set of HRTFs.

The audio system 300 generates 450 updated audio content using the customized set of HRTFs. Similar to step 410, the controller 330—or more specifically the audio content engine 370—of the audio system 300 may update 450 the audio content. The audio content engine 370 utilizes the customized set of HRTFs for the user to update the audio content. The updated audio content is then provided from the audio content engine 370 to the audio assembly 310.

The audio system 300 presents 460 the updated audio content to the user. In some embodiments, the audio assembly 310 of the audio system 300 presents 460 the updated audio content. The audio assembly 310 receives the updated audio content which may comprise binaural acoustic signals for generation of acoustic pressure waves to each ear of the user. The audio assembly 310 includes one or more acoustic speakers that provide the audio content to the ears of the user.

The process 400 for customizing a set of HRTFs for a user based on monitored user responses provides an improved user experience. Compared to the conventional audio systems described above, the process 400 incorporates user feedback in customization of the set of HRTFs. Other conventional audio systems do not rely on a user's hearing perception but simply attempts to predict the user's hearing perception by modeling the transfer of sound from a local area into a user's ear canals. However, instances arise where the user's hearing perception is not just influenced by the transfer of sound according to the user's head and/or body shape but is also influenced by a psychological aspect of having trained the user's brain in perceiving sounds. The process 400 accounts for the psychological aspect as well allowing the user to respond to audio content according to their hearing perception influenced by the transfer of sound into their ear canals and by their trained brain.

Artificial Reality System Environment

Figure 5:
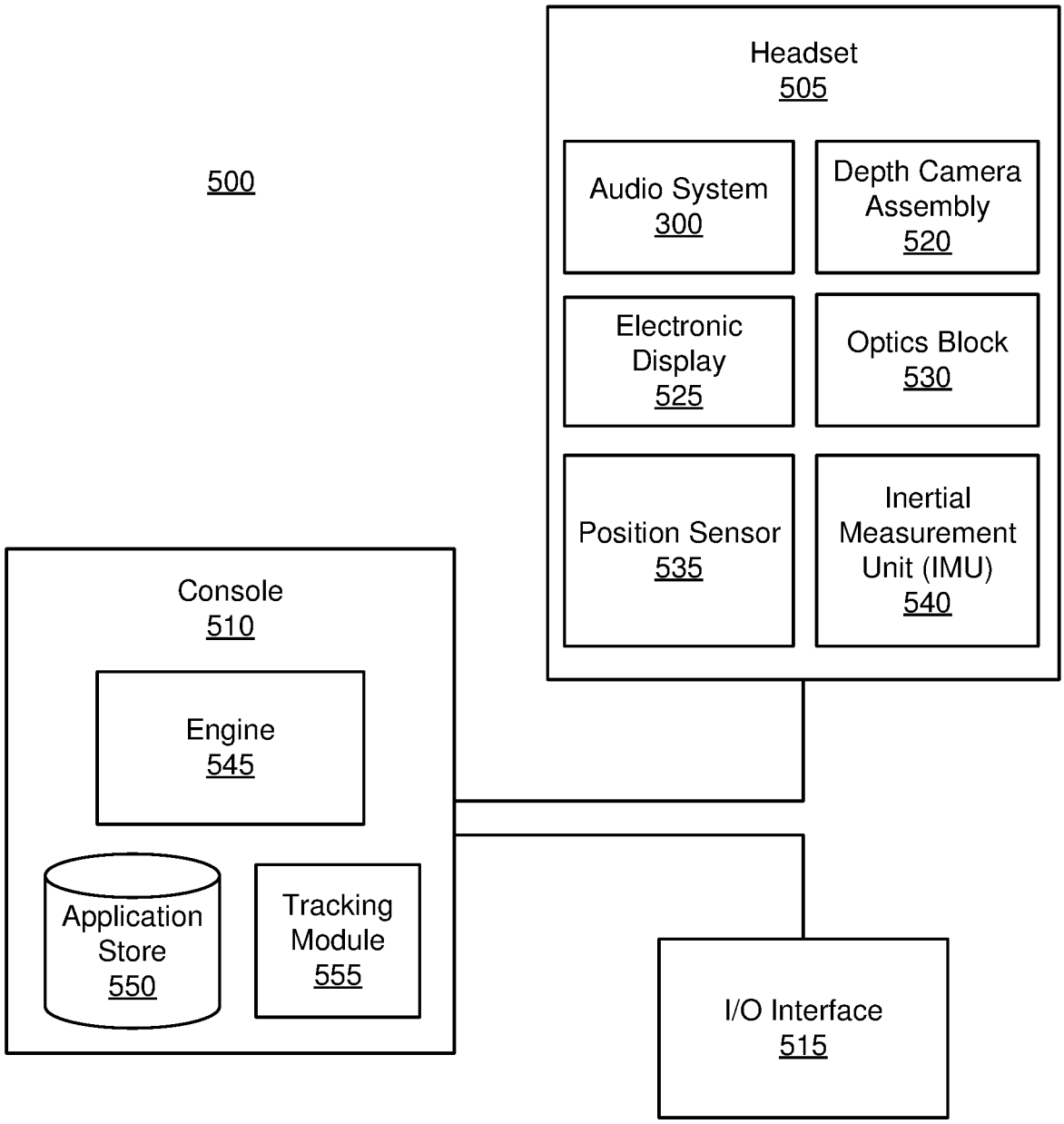
FIG. 5 is a system environment of a headset including the audio system 300 of FIG. 3, in accordance with one or more embodiments.

FIG. 5 is a system environment of a headset including the audio system 300 of FIG. 3, in accordance with one or more embodiments. The system 500 may operate in an artificial reality environment, e.g., a virtual reality, an augmented reality, a mixed reality environment, or some combination thereof. The system 500 shown by FIG. 5 comprises a headset 505 and an input/output (I/O) interface 515 that is coupled to a console 510. The headset 505 may be an embodiment of the headset 200. While FIG. 5 shows an example system 500 including one headset 505 and one I/O interface 515, in other embodiments, any number of these components may be included in the system 500. For example, there may be multiple headsets 505 each having an associated I/O interface 515 with each headset 505 and I/O interface 515 communicating with the console 510. In alternative configurations, different and/or additional components may be included in the system 500. Additionally, functionality described in conjunction with one or more of the components shown in FIG. 5 may be distributed among the components in a different manner than described in conjunction with FIG. 5 in some embodiments. For example, some or all of the functionality of the console 510 is provided by the headset 505.

The headset 505 presents content to a user comprising augmented views of a physical, real-world environment with computer-generated elements (e.g., two dimensional (2D) or three dimensional (3D) images, 2D or 3D video, sound, etc.). The headset 505 may be an eyewear device or a head-mounted display. In some embodiments, the presented content includes audio that is presented via an audio system 300 that receives audio information from the headset 505, the console 510, or both, and presents audio content based on the audio information. In some embodiments, the headset 505 presents virtual content to the user that is based in part on a real local area surrounding the user. For example, virtual content may be presented to a user of the headset 505. The user physically may be in a room, and virtual walls and a virtual floor of the room are rendered as part of the virtual content.

The headset 505 includes the audio system 300 of FIG. 3. The audio system 300 presents audio content according customized sets of HRTFs. As describe above, the audio system 300 may include an audio assembly 310, a monitoring assembly 320, and a controller 330. The audio system 300 provides audio content to the user of the headset 505 according to a set of HRTFs for the user. Based on monitored responses as detected by the monitoring assembly 320, the controller 330 may customized the set of HRTFs and also update the audio content to reflect the customized set of HRTFs. The customization of the HRTFs aims to account for a user's hearing perception by adjusting the HRTFs according to the monitored responses of the user to audio content. The monitoring assembly 310 of the audio system 300 may include any number of monitoring devices which could be other components in the system 500, as will be mentioned in discussion of the subsequent components.

The headset 505 also includes a depth camera assembly (DCA) 520, an electronic display 525, an optics block 530, one or more position sensors 535, and an inertial measurement Unit (IMU) 540. The electronic display 525 and the optics block 530 is one embodiment of a lens 210. The position sensors 535 and the IMU 540 is one embodiment of sensor device 215. Some embodiments of the headset 505 have different components than those described in conjunction with FIG. 5. Additionally, the functionality provided by various components described in conjunction with FIG. 5 may be differently distributed among the components of the headset 505 in other embodiments, or be captured in separate assemblies remote from the headset 505.

The DCA 520 captures data describing depth information of a local environment surrounding some or all of the headset 505. The DCA 520 may include a light generator, an imaging device, and a DCA controller that may be coupled to both the light generator and the imaging device. The light generator illuminates a local area with illumination light, e.g., in accordance with emission instructions generated by the DCA controller. The DCA controller is configured to control, based on the emission instructions, operation of certain components of the light generator, e.g., to adjust an intensity and a pattern of the illumination light illuminating the local area. In some embodiments, the illumination light may include a structured light pattern, e.g., dot pattern, line pattern, etc. The imaging device captures one or more images of one or more objects in the local area illuminated with the illumination light. The DCA 520 can compute the depth information using the data captured by the imaging device or the DCA 520 can send this information to another device such as the console 510 that can determine the depth information using the data from the DCA 520.

The electronic display 525 displays 2D or 3D images to the user in accordance with data received from the console 510. In various embodiments, the electronic display 525 comprises a single electronic display or multiple electronic displays (e.g., a display for each eye of a user). Examples of the electronic display 525 include: a liquid crystal display (LCD), an organic light emitting diode (OLED) display, an active-matrix organic light-emitting diode display (AMOLED), a waveguide display, some other display, or some combination thereof.

The optics block 530 magnifies image light received from the electronic display 525, corrects optical errors associated with the image light, and presents the corrected image light to a user of the headset 505. In various embodiments, the optics block 530 includes one or more optical elements. Example optical elements included in the optics block 530 include: a waveguide, an aperture, a Fresnel lens, a convex lens, a concave lens, a filter, a reflecting surface, or any other suitable optical element that affects image light. Moreover, the optics block 530 may include combinations of different optical elements. In some embodiments, one or more of the optical elements in the optics block 530 may have one or more coatings, such as partially reflective or anti-reflective coatings.

Magnification and focusing of the image light by the optics block 530 allows the electronic display 525 to be physically smaller, weigh less, and consume less power than larger displays. Additionally, magnification may increase the field of view of the content presented by the electronic display 525. For example, the field of view of the displayed content is such that the displayed content is presented using almost all (e.g., approximately 110 degrees diagonal), and in some cases all, of the user's field of view. Additionally, in some embodiments, the amount of magnification may be adjusted by adding or removing optical elements.

In some embodiments, the optics block 530 may be designed to correct one or more types of optical error. Examples of optical error include barrel or pincushion distortion, longitudinal chromatic aberrations, or transverse chromatic aberrations. Other types of optical errors may further include spherical aberrations, chromatic aberrations, or errors due to the lens field curvature, astigmatisms, or any other type of optical error. In some embodiments, content provided to the electronic display 525 for display is predistorted, and the optics block 530 corrects the distortion when it receives image light from the electronic display 525 generated based on the content.

The IMU 540 is an electronic device that generates data indicating a position of the headset 505 based on measurement signals received from one or more of the position sensors 535. A position sensor 535 generates one or more measurement signals in response to motion of the headset 505. Examples of position sensors 535 include: one or more accelerometers, one or more gyroscopes, one or more magnetometers, another suitable type of sensor that detects motion, a type of sensor used for error correction of the IMU 540, or some combination thereof. The position sensors 535 may be located external to the IMU 540, internal to the IMU 540, or some combination thereof. In one or more embodiments, the IMU 540 and/or the position sensor 535 may be monitoring devices of the monitoring assembly 320 capable of monitoring responses of the user to audio content provided by the audio system 300.

Based on the one or more measurement signals from one or more position sensors 535, the IMU 540 generates data indicating an estimated current position of the headset 505 relative to an initial position of the headset 505. For example, the position sensors 535 include multiple accelerometers to measure translational motion (forward/back, up/down, left/right) and multiple gyroscopes to measure rotational motion (e.g., pitch, yaw, and roll). In some embodiments, the IMU 540 rapidly samples the measurement signals and calculates the estimated current position of the headset 505 from the sampled data. For example, the IMU 540 integrates the measurement signals received from the accelerometers over time to estimate a velocity vector and integrates the velocity vector over time to determine an estimated current position of a reference point on the headset 505. Alternatively, the IMU 540 provides the sampled measurement signals to the console 510, which interprets the data to reduce error. The reference point is a point that may be used to describe the position of the headset 505. The reference point may generally be defined as a point in space or a position related to the headset's 505 orientation and position.

The I/O interface 515 is a device that allows a user to send action requests and receive responses from the console 510. An action request is a request to perform a particular action. For example, an action request may be an instruction to start or end capture of image or video data, or an instruction to perform a particular action within an application. The I/O interface 515 may include one or more input devices. Example input devices include: a keyboard, a mouse, a hand controller, or any other suitable device for receiving action requests and communicating the action requests to the console 510. An action request received by the I/O interface 515 is communicated to the console 510, which performs an action corresponding to the action request. In some embodiments, the I/O interface 515 includes an IMU 540, as further described above, that captures calibration data indicating an estimated position of the I/O interface 515 relative to an initial position of the I/O interface 515. In some embodiments, the I/O interface 515 may provide haptic feedback to the user in accordance with instructions received from the console 510. For example, haptic feedback is provided when an action request is received, or the console 510 communicates instructions to the I/O interface 515 causing the I/O interface 515 to generate haptic feedback when the console 510 performs an action. The I/O interface 515 may be configured for use as a monitoring device of the monitoring assembly 320 of the audio system 300. The I/O interface 515 may monitor one or more input responses from the user for use in determining a perceived origin direction and/or perceived origin location of audio content.

The console 510 provides content to the headset 505 for processing in accordance with information received from one or more of: the headset 505 and the I/O interface 515. In the example shown in FIG. 5, the console 510 includes an application store 550, a tracking module 555 and an engine 545. Some embodiments of the console 510 have different modules or components than those described in conjunction with FIG. 5. Similarly, the functions further described below may be distributed among components of the console 510 in a different manner than described in conjunction with FIG. 5.

The application store 550 stores one or more applications for execution by the console 510. An application is a group of instructions, that when executed by a processor, generates content for presentation to the user. Content generated by an application may be in response to inputs received from the user via movement of the headset 505 or the I/O interface 515. Examples of applications include: gaming applications, conferencing applications, video playback applications, or other suitable applications.

The tracking module 555 calibrates the system environment 500 using one or more calibration parameters and may adjust one or more calibration parameters to reduce error in determination of the position of the headset 505 or of the I/O interface 515. Calibration performed by the tracking module 555 also accounts for information received from the IMU 540 in the headset 505 and/or an IMU 540 included in the I/O interface 515. Additionally, if tracking of the headset 505 is lost, the tracking module 555 may re-calibrate some or all of the system environment 500.

The tracking module 555 tracks movements of the headset 505 or of the I/O interface 515 using information from the one or more position sensors 535, the IMU 540, the DCA 520, or some combination thereof. For example, the tracking module 555 determines a position of a reference point of the headset 505 in a mapping of a local area based on information from the headset 505. The tracking module 555 may also determine positions of the reference point of the headset 505 or a reference point of the I/O interface 515 using data indicating a position of the headset 505 from the IMU 540 or using data indicating a position of the I/O interface 515 from an IMU 540 included in the I/O interface 515, respectively. Additionally, in some embodiments, the tracking module 555 may use portions of data indicating a position or the headset 505 from the IMU 540 to predict a future position of the headset 505. The tracking module 555 provides the estimated or predicted future position of the headset 505 or the I/O interface 515 to the engine 545. The tracking module 555 may be a monitoring device of the monitoring assembly 320 providing the audio system 300 with tracking responses of the headset 505 and/or the I/O interface 515 to be used as monitored responses in customizing HRTFs.

The engine 545 also executes applications within the system environment 500 and receives position information, acceleration information, velocity information, predicted future positions, or some combination thereof, of the headset 505 from the tracking module 555. Based on the received information, the engine 545 determines content to provide to the headset 505 for presentation to the user. For example, if the received information indicates that the user has looked to the left, the engine 545 generates content for the headset 505 that mirrors the user's movement in a virtual environment or in an environment augmenting the local area with additional content. Additionally, the engine 545 performs an action within an application executing on the console 510 in response to an action request received from the I/O interface 515 and provides feedback to the user that the action was performed. The provided feedback may be visual or audible feedback via the headset 505 or haptic feedback via the I/O interface 515.

Additional Configuration Information

The foregoing description of the embodiments of the disclosure has been presented for the purpose of illustration; it is not intended to be exhaustive or to limit the disclosure to the precise forms disclosed. Persons skilled in the relevant art can appreciate that many modifications and variations are possible in light of the above disclosure.

Some portions of this description describe the embodiments of the disclosure in terms of algorithms and symbolic representations of operations on information. These algorithmic descriptions and representations are commonly used by those skilled in the data processing arts to convey the substance of their work effectively to others skilled in the art. These operations, while described functionally, computationally, or logically, are understood to be implemented by computer programs or equivalent electrical circuits, microcode, or the like. Furthermore, it has also proven convenient at times, to refer to these arrangements of operations as modules, without loss of generality. The described operations and their associated modules may be embodied in software, firmware, hardware, or any combinations thereof.

Any of the steps, operations, or processes described herein may be performed or implemented with one or more hardware or software modules, alone or in combination with other devices. In one embodiment, a software module is implemented with a computer program product comprising a computer-readable medium containing computer program code, which can be executed by a computer processor for performing any or all of the steps, operations, or processes described.

Embodiments of the disclosure may also relate to an apparatus for performing the operations herein. This apparatus may be specially constructed for the required purposes, and/or it may comprise a general-purpose computing device selectively activated or reconfigured by a computer program stored in the computer. Such a computer program may be stored in a non-transitory, tangible computer readable storage medium, or any type of media suitable for storing electronic instructions, which may be coupled to a computer system bus. Furthermore, any computing systems referred to in the specification may include a single processor or may be architectures employing multiple processor designs for increased computing capability.

Embodiments of the disclosure may also relate to a product that is produced by a computing process described herein. Such a product may comprise information resulting from a computing process, where the information is stored on a non-transitory, tangible computer readable storage medium and may include any embodiment of a computer program product or other data combination described herein.

Finally, the language used in the specification has been principally selected for readability and instructional purposes, and it may not have been selected to delineate or circumscribe the inventive subject matter. It is therefore intended that the scope of the disclosure be limited not by this detailed description, but rather by any claims that issue on an application based hereon. Accordingly, the disclosure of the embodiments is intended to be illustrative, but not limiting, of the scope of the disclosure, which is set forth in the following claims.

What is claimed is:

1. A method comprising:

presenting, via speakers on a headset, audio content to a user wearing the headset, the audio content generated using a set of head related transfer functions (HRTFs);

monitoring responses of the user to the audio content;

customizing the set of HRTFs for the user based on the monitored responses by:

determining a cluster of perceived origin directions, wherein each perceived origin direction of the cluster is a spatial direction in three-dimensional (3D) space where the audio content is perceived by the user to originate from, determining a difference between a target presentation direction within the local area for the audio content and a direction of the cluster, and adjusting an HRTF in the set of HRTFs based on the difference;

generating updated audio content using the customized set of HRTFs; and presenting, via the speakers on the headset, the updated audio content to the user.

2. The method of claim 1, further comprising:

generating the set of HRTFs, wherein the set of HRTFs are generated using one or more generic HRTFs that are based on a model of a human.

3. The method of claim 1, wherein the responses of the user are selected from a group consisting of:

a position of a limb of the user;

a movement of a body of the user;

a movement of the headset;

an orientation of the headset;

a gaze location of the user;

an input from the user; and any combination thereof.

4. The method of claim 1, wherein the adjusting the HRTF in the set of HRTFs based on the difference, comprises:

adjusting the HRTF according to a lateralization bias, wherein the lateralization bias is a lateral differential between a perceived origin direction and the target presentation direction.

5. The method of claim 1, wherein the adjusting the HRTF in the set of HRTFs based on the difference, comprises:

adjusting the HRTF according to an elevation bias, wherein the elevation bias is an elevation differential between a perceived origin direction and the target presentation direction.

6. The method of claim 1, further comprising:

prompting the user to look at a perceived origin direction;

determining an orientation of the headset while the user looks at the perceived origin direction, wherein the orientation of the headset is one of the monitored responses; and wherein the customizing the set of HRTFs for the user is based on the determined orientation.

7. An audio system comprising:

an audio assembly comprising one or more speakers configured to present audio content to a user of the audio system;

a monitoring assembly configured to monitor responses of the user to the audio content;

a controller configured to:

generate audio content using a set of head related transfer functions (HRTFs);

customize the set of HRTFs for the user based on at least one of the monitored responses by:

determining a cluster of perceived origin directions, wherein each perceived origin direction of the cluster is a spatial direction in three-dimensional (3D) space where the audio content is perceived by the user to originate from, determining a difference between a target presentation direction within the local area for the audio content and a direction of the cluster, and adjusting an HRTF in the set of HRTFs based on the difference; and generate updated audio content using the customized set of HRTFs.

8. The audio system of claim 7, wherein the controller is further configured to:

generate the set of HRTFs using one or more generic HRTFs that are based on a model of a human.

9. The audio system of claim 7, wherein the responses of the user are selected from a group consisting of:

a position of a limb of the user as tracked by a tracking system;

a movement of a body of the user as tracked by the tracking system;

a movement of a head of the user as tracked by the tracking system;

a gaze location of the user as tracked by the tracking system;

an input as received by an input device; and any combination thereof.

10. The audio system of claim 7, wherein the controller is further configured to:

adjust the HRTF according to a lateralization bias, wherein the lateralization bias is a lateral differential between a perceived origin direction and the target presentation direction.

11. The audio system of claim 7, wherein the controller is further configured to:

adjust the HRTF according to an elevation bias, wherein the elevation bias is an elevation differential between a perceived origin direction and the target presentation direction.

12. The audio system of claim 7, wherein the audio system is further configured to prompt the user to look at a perceived origin direction;

wherein the monitoring assembly is further configured to determine an orientation of the headset while the user looks at the perceived origin direction, wherein the orientation of the headset is one of the monitored responses; and wherein the controller is further configured to customize the set of HRTFs for the user is based on the determined orientation.

13. The audio system of claim 7, wherein the audio system is a component of a headset.

14. A non-transitory computer-readable storage medium storing encoded instructions that, when executed by a processor, cause the processor to accomplish steps of:

presenting, via speakers on a headset, audio content to a user wearing the headset, the audio content generated using a set of head related transfer functions (HRTFs);

monitoring responses of the user to the audio content;

customizing the set of HRTFs for the user based on at least one of the monitored responses by:

determining a cluster of perceived origin directions, wherein each perceived origin direction of the cluster is a spatial direction in three-dimensional (3D) space where the audio content is perceived by the user to originate from, determining a difference between a target presentation direction within the local area for the audio content and a direction of the cluster, and adjusting an HRTF in the set of HRTFs based on the difference;

generating updated audio content using the customized set of HRTFs; and presenting the updated audio content to the user.

15. The non-transitory computer-readable storage medium of claim 14, wherein the steps further comprise:

generating the set of HRTFs, wherein the set of HRTFs are generated using one or more generic HRTFs that are based on a model of a human.

16. The non-transitory computer-readable storage medium of claim 14, wherein adjusting the HRTF in the set of HRTFs based on the difference, comprises:

adjusting the HRTF according to a lateralization bias, wherein the lateralization bias is a lateral differential between a perceived origin direction and the target presentation direction.

17. The non-transitory computer-readable storage medium of claim 14, wherein adjusting the HRTF in the set of HRTFs based on the difference, comprises:

adjusting the HRTF according to an elevation bias, wherein the elevation bias is an elevation differential between a perceived origin direction and the target presentation direction.

18. The non-transitory computer-readable storage medium of claim 14, wherein the steps further comprise:

prompting the user to look at a perceived origin direction;

determining an orientation of the headset while the user looks at the perceived origin direction, wherein the orientation of the headset is one of the monitored responses; and wherein the customizing the set of HRTFs for the user is based on the determined orientation.

* * * * *